US008478168B2

(12) United States Patent
Lewis

(10) Patent No.: US 8,478,168 B2
(45) Date of Patent: Jul. 2, 2013

(54) CHARGING ROLLER FOR AN IMAGING DEVICE

(75) Inventor: Lawrence Dale Lewis, Sanford, NC (US)

(73) Assignee: Static Control Components, Inc., Sanford, NC (US)

( * ) Notice: Subject to any disclaimer, the term of this patent is extended or adjusted under 35 U.S.C. 154(b) by 210 days.

(21) Appl. No.: 12/827,328

(22) Filed: Jun. 30, 2010

(65) Prior Publication Data

US 2012/0003011 A1 Jan. 5, 2012

(51) Int. Cl.
*G03G 15/02* (2006.01)

(52) U.S. Cl.
USPC ..... 399/176

(58) Field of Classification Search
USPC ..... 399/176
See application file for complete search history.

(56) References Cited

U.S. PATENT DOCUMENTS 5,241,343 A * 8/1993 Nishio ..... 399/90

FOREIGN PATENT DOCUMENTS

JP 05257362 A * 10/1993
JP 09197767 A * 7/1997

* cited by examiner

*Primary Examiner* — Quana M Grainger

(57) ABSTRACT

A charging roller for an imaging device may include a shaft having a shaft length; a cylindrical foam layer partially covering the shaft and having a foam thickness, a first foam end and a second foam end, the cylindrical foam layer having a foam length less than the shaft length; a skin layer covering the cylindrical foam layer; and first and second retention members, the first retention member disposed adjacent to the first foam end and the second retention member disposed adjacent to the second foam end.

3 Claims, 4 Drawing Sheets

CHARGING ROLLER FOR AN IMAGING DEVICE

BACKGROUND

The present invention generally relates to manufacturing, remanufacturing or repairing replaceable imaging components, and more particularly to apparatus and techniques for providing a charging roller for a replaceable imaging cartridge adapted for holding marking material.

In the imaging industry, there is a growing market for the remanufacture and refurbishing of various types of replaceable imaging cartridges such as toner cartridges, drum cartridges, inkjet cartridges, and the like. These imaging cartridges are used in imaging devices such as laser printers, xerographic copiers, inkjet printers, facsimile machines and the like, for example. Imaging cartridges, once spent, are unusable for their originally intended purpose. Without a refurbishing process these cartridges would simply be discarded, even though the cartridge itself may still have potential life. As a result, techniques have been developed specifically to address this issue. These processes may entail, for example, the disassembly of the various structures of the cartridge, replacing toner or ink, cleaning, adjusting or replacing any worn components and reassembling the imaging cartridge.

In imaging cartridges used in the electrophotographic process, a light sensitive material is selectively charged in the presence of light. This light sensitive material is typically in the form of an endless belt or in the shape of a cylinder of light sensitive material, such as a photographic drum or an organic photoconductive drum. The electric charge on a drum differentially attracts toner which is then used to form an image on paper or other media. After an image is formed and transferred to the media, it is necessary to erase the charge which was previously placed on the drum and replace the previous charge with a new uniform charge suitable for being reimaged. The charging roller may erase the previous charge and provides the new uniform charge. The charging roller rests against the drum and is provided with the necessary voltages. Charging rollers may be cylindrical in shape and include a metal shaft surrounded by a conductive foam or elastic material.

SUMMARY

In one aspect of the present invention, a charging roller for an imaging device may include a shaft having a shaft length; a cylindrical foam layer partially covering the shaft and having a foam thickness, a first foam end and a second foam end, the cylindrical foam layer having a foam length less than the shaft length; a skin layer covering the cylindrical foam layer; and first and second retention members, the first retention member disposed adjacent to the first foam end and the second retention member disposed adjacent to the second foam end.

A more complete understanding of the present invention, as well as further features and advantages of the invention, will be apparent from the following detailed description and the accompanying drawings.

DETAILED DESCRIPTION

The following detailed description of preferred embodiments refers to the accompanying drawings which illustrate specific embodiments of the invention. Other embodiments having different structures for a charging roller with retention member, do not depart from the scope of the present invention.

Figure 1:
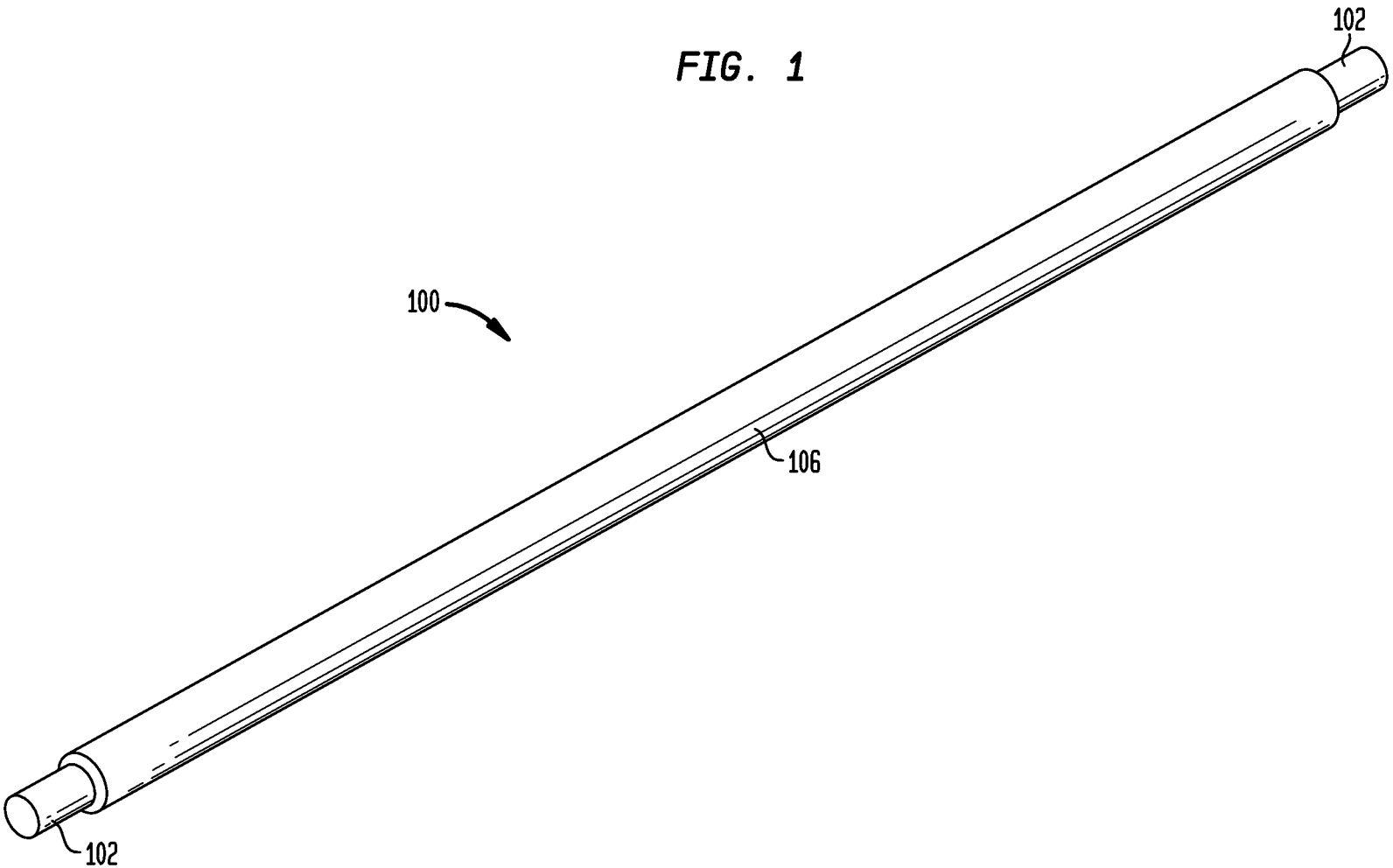
FIG. 1 shows a perspective view of a charging roller in accordance with the present invention.
Figure 2:
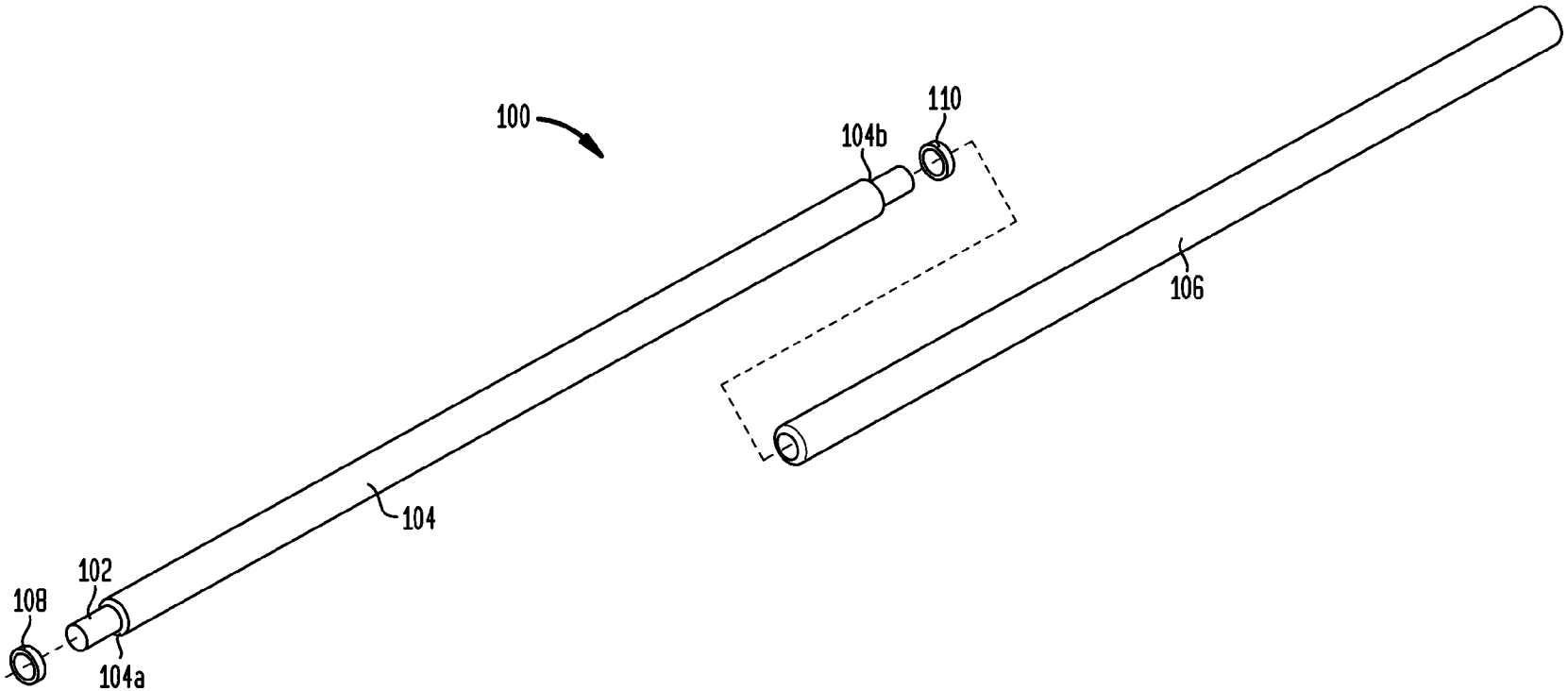
FIG. 2 shows an exploded, perspective view of a charging roller in accordance with the present invention.

FIG. 1 shows a perspective view of a charging roller 100 in accordance with the present invention, and FIG. 2 shows an exploded perspective view of the charging roller 100. The charging roller 100 includes a shaft 102. The shaft 102 is preferably cylindrical in shape and may suitably comprise an oxidizing resistant metal, such as stainless steel, nickel-coated steel or phosphorus bronze, for example.

The shaft 102 is partially covered by a cylindrical foam layer 104 having ends 104*a* and 104*b*. The cylindrical foam layer 104 may suitably comprise conductive foam which is extruded and then placed around the shaft 102.

Figure 3:
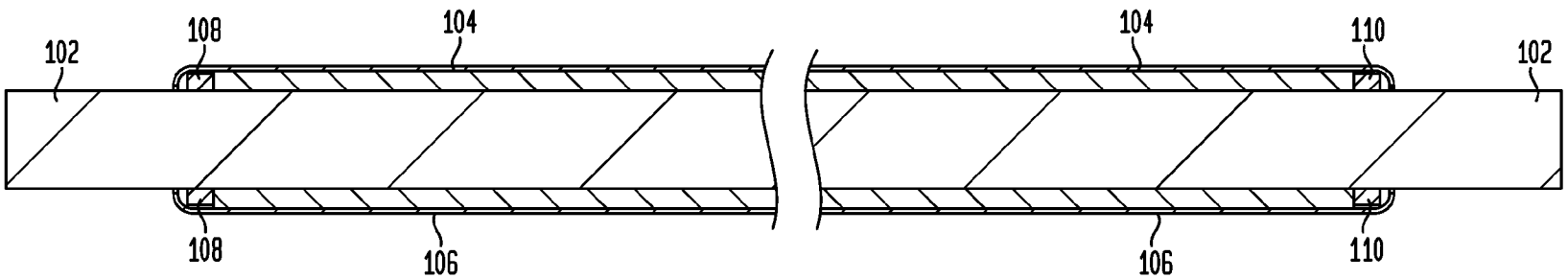
FIG. 3 shows a cross-sectional view of a charging roller in accordance with the present invention.
Figure 4:
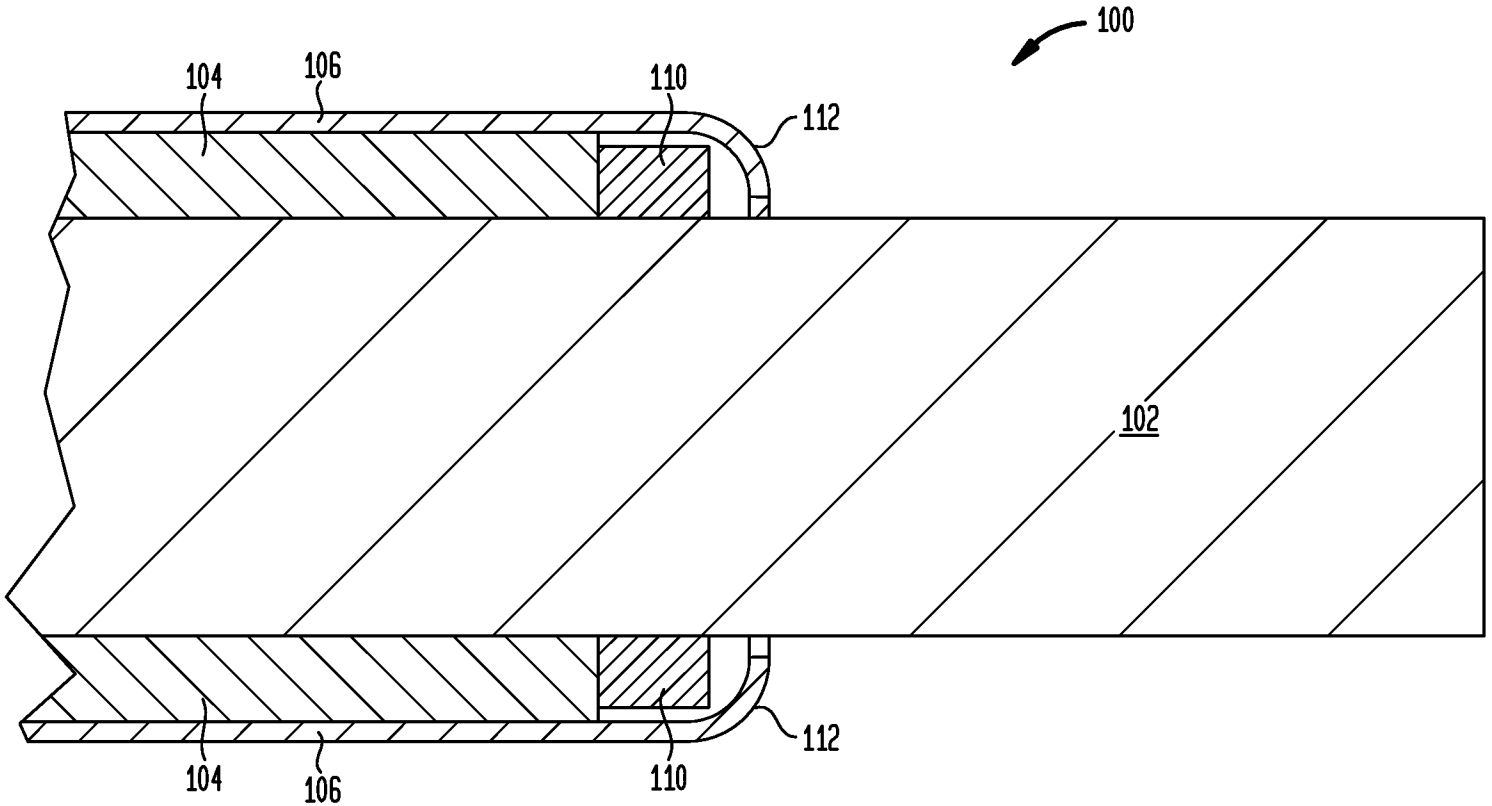
FIG. 4 shows a detailed cross-sectional view of an end of a charging roller in accordance with the present invention.

As best seen in FIGS. 2-4, retention members 108 and 110 are disposed around the shaft 102 near the ends 104*a* and 104*b* of the cylindrical foam layer 104. During operation of the charging roller 100, the retention members 108 and 110 may prevent the cylindrical foam layer 104 from shifting along the length of the shaft 102. Additionally, the retention members 108 and 110 may prevent a skin layer 106 (described below) from moving or shifting on the cylindrical foam layer 104. Each retention member 108 and 110 is preferably an O-ring secured to the shaft 102 by frictional forces of compression, but alternatively may comprise one or more drops of an adhesive attached to the shaft 102. The O-ring may comprise an elastomeric material such as butyl rubber, for example. In a preferred embodiment, the retaining members 108 and 110 may each have a thickness less than the thickness of the cylindrical foam layer 104. Alternatively, the retaining members 108 and 110 may each have a thickness equal to the thickness of the cylindrical foam layer 104.

A skin layer 106 covers the cylindrical foam layer 104 and retention members 108 and 110. The skin layer 106 may suitably comprise a conductive plastic, such as thermal plastic elastomer or blocked copolymer, for example, which may be formed by an extrusion process and then placed over the cylindrical foam layer 104. The length of the skin layer 106 may be equal to or greater than the length of the cylindrical foam layer 104. If the length of the skin layer 106 is greater than the length of the cylindrical foam layer 104, then the skin layer 106 is preferably crimped down over the retaining members by heat staking. FIG. 4 shows a crimped area 112 of the skin layer 106.

Although specific embodiments have been illustrated and described herein, those of ordinary skill in the art appreciate that any arrangement that is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A charging roller for an imaging device comprising:

a shaft having a shaft length;

a cylindrical foam layer partially covering the shaft and having a foam thickness, a first foam end and a second foam end, the cylindrical foam layer having a foam length less than the shaft length;

a skin layer covering the cylindrical foam layer; and first and second retention members, the first retention member disposed adjacent to the first foam end and the second retention member disposed adjacent to the second foam end, wherein the length of the skin layer is the same as the length of the foam.

2. The charging roller of claim 1 wherein the cylindrical foam layer comprises a conductive foam.

3. The charging roller of claim 2 wherein the cylindrical foam layer is extruded and placed around the shaft.

* * * * *